United States Patent [19]

Hamaoka et al.

[11] 4,366,226

[45] Dec. 28, 1982

[54] COLOR PHOTOGRAPHIC SENSITIVE MATERIAL WITH SULFONAMIDOPHENOL SCAVENGER

[75] Inventors: Tsutomu Hamaoka; Osamu Takahashi; Tooru Harada; Minoru Sakai; Nobutaka Ohki, all of Minami-ashigara, Japan

[73] Assignee: Fuji Photo Film Co., Ltd., Kanagawa, Japan

[21] Appl. No.: 285,721

[22] Filed: Jul. 22, 1981

[30] Foreign Application Priority Data

Jul. 22, 1980 [JP] Japan ..... 55/100287

[51] Int. Cl.[3] ..... G03C 1/40; G03C 1/10; G03C 5/54

[52] U.S. Cl. ..... 430/214; 430/372; 430/551; 430/559

[58] Field of Search ..... 430/214, 223, 551, 372, 430/559, 236

[56] References Cited

U.S. PATENT DOCUMENTS

| | | | |
|---|---|---|---|
| 4,055,428 | 10/1977 | Koyama et al. | 430/223 |
| 4,205,987 | 6/1980 | Erikson et al. | 430/223 |
| 4,310,693 | 1/1982 | Fujita et al. | 430/223 |

OTHER PUBLICATIONS

"Photographic Processes and Products", *Research Disclosure* No. 15162, 11/76, pp. 76–87.

Gutierrez et al., "Scavenger Compounds", *Research Disclosure* No. 17842, 2/79, pp. 94–97.

*Primary Examiner*—Richard L. Schilling

*Attorney, Agent, or Firm*—Sughrue, Mion, Zinn, Macpeak & Seas

[57] ABSTRACT

A color photographic silver halide light-sensitive material is described comprising a compound represented by formula (I)

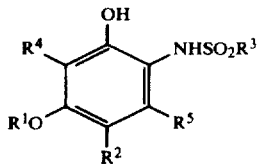

(I)

wherein $R^1$ and $R^3$ can each represent an unsubstituted or substituted alkyl group or an unsubstituted or substituted aryl group, $R^2$ can represent an unsubstituted or substituted alkyl group, $R^4$ and $R^5$ can each represent a hydrogen atom, an unsubstituted or substituted alkyl group, an unsubstituted or substituted aryloxy group, an unsubstituted or substituted alkylthio group, an unsubstituted or substituted arylthio group, a halogen atom, or an acylamino group, and $R^1$ and $R^2$, $R^1$ and $R^4$, or $R^2$ and $R^5$ together can represent atoms forming a condensed ring structure together with the benzene ring of formula (I), provided that the total of carbon atom numbers in $R^1$, $R^2$, $R^3$, $R^4$ and $R^5$ is at least 16.

11 Claims, No Drawings

COLOR PHOTOGRAPHIC SENSITIVE MATERIAL WITH SULFONAMIDOPHENOL SCAVENGER

FIELD OF THE INVENTION

The present invention relates to color photographic sensitive materials. More particularly, it relates to color diffusion transfer photographic sensitive materials containing a 2-sulfonamidophenolic compound as an oxidized developing agent scavenger.

BACKGROUND OF THE INVENTION

It has been known that "color fogging" phenomenon is caused in color photographic sensitive materials which contain a compound (referred to as a dye releasing redox, or DRR, compound) which releases a diffusible dye by a redox reaction upon development of a silver halide photographic sensitive material, and are developed with a black-white developing agent such as phenidone, etc., or in color photographic sensitive materials which contain couplers and are developed with a color developing agent, and it has been well known that various oxidized developing agent scavengers are used for preventing such a phenomenon.

In the case of color photography, the above-described oxidized developing agent scavenger is incorporated in intermediate layers in order to obtain good color separation or in silver halide emulsion layers or layers containing a dye image donator (for example, the combination of a dye releasing redox compound and a coupler) combined with the silver halide emulsion layer in order to obtain a reduced minimum density.

It has been well known heretofore to use various substituted hydroquinones as an oxidized developing agent scavenger. For example, use of mono-substituted alkylhydroquinones is described in U.S. Pat. Nos. 2,360,290, 2,418,613, 2,403,721 and 3,960,570. Further, methods using mono-branched alkylhydroquinones are described in U.S. Pat. No. 3,700,453, German Patent Application (OLS) No. 2,149,789, and Japanese Patent Application (OPI) Nos. 156438/75 and 106329/74 (the term "OPI" as used herein refers to a "published unexamined Japanese patent application"). Use of disubstituted alkylhydroquinones is described in U.S. Pat. Nos. 2,728,659, 2,732,300 and 3,243,294, British Pat. No. 752,146 and *Chemical Abstracts*, Vol. 56, 6367h, and use of a di-branched alkylhydroquinones is described in U.S. Pat. Nos. 3,700,453, 2,732,300 and 3,243,294, *Chemical Abstracts*, Vol. 56, 6367h, Japanese Patent Application (OPI) Nos. 156438/75, 9528/78, 29637/79 and Japanese Patent Publication No. 21249/75.

In addition, use of substituted hydroquinones as the oxidized developing agent scavenger has been described in U.S. Pat. Nos. 2,701,197, 2,710,801, and 2,704,713.

Furthermore, use of sulfonamidophenols as the oxidized developing agent scavenger has been described in *Research Disclosure*, 15162 (No. 151, 1976) page 83 and Japanese Patent Application (OPI) No. 72158/80.

However, since the above-described known compounds do not completely satisfy all desired properties for the oxidized developing agent scavenger in color photography, particularly, in a color diffusion transfer process, it has been desired to discover more suitable compounds. These desired properties are described in detail below.

(1) The oxidized developing agent scavenger is a compound capable of suitably reacting with a oxidized developing agent formed by development of silver halide. For example, a compound to be incorporated in an intermediate layer is incorporated in the intermediate layer located between a silver halide emulsion layer and a layer containing a dye releasing redox compound (or a coupler) which is not associated with the emulsion layer in order to prevent reacting the oxidized developing agent formed by development of silver halide with the dye releasing redox compound (or the coupler) which is not combined with said silver halide. "Associated" as used herein refers a compound being present in the same, or an adjacent layer, with respect to a particular silver halide emulsion layer. In this case, it is necessary that the compound reacts with the oxidized developing agent to "capture" it to the extent that diffusion of the oxidized developing agent into the layer containing the dye releasing redox compound (or coupler) which is not associated is substantially nothing.

If the reactivity of the compound with the oxidized developing agent is too high, the compound interferes with the reaction of the oxidized developing agent formed by development of silver halide with the dye releasing redox compound associated with said silver halide to deteriorate the maximum dye image density. Accordingly, it is desired to have a suitable reactivity.

(2) Film thickness of the photosensitive material can be minimized when the oxidized developing agent scavenger is added to the photosensitive material. In the case of a color diffusion process, it is often necessary that a dye released from a dye releasing redox compound passes through the layer containing the oxidized developing agent scavenger. The film thickness of the layer containing the oxidized developing agent scavenger can be decreased as the amount of the oxidized developing agent scavenger and other materials required for addition of the oxidized developing agent scavenger (e.g., gelatin and high boiling point solvents). Consequently, the time necessary for passage of the released dye through this layer is shortened, and sharpness of transfer images is improved. In an instant color diffusion transfer process wherein it is required to complete image formation in as short a time as possible, it is particularly important to minimize the film thickness.

(3) Adverse influences upon the silver developing property in the silver halide emulsion are lessened when the oxidized developing agent scavenger is added to the photosensitive material. Particularly in the case of a developing process in which a positive image is formed directly by use of an inner latent image type silver halide emulsion, the oxidized developing agent scavenger in the silver halide emulsion layer or in the layer adjacent to the silver halide emulsion layer often has adverse influences upon the silver development property. Accordingly, it is desirable to use a compound having less adverse influences.

(4) The oxidized developing agent scavenger should not reduce a diffusible dye or a diffusible dye precursor to change its hue when subjected to high pH development processing. Particularly, some dialkylhydroquinone compounds in oxidized developing agent scavengers sometimes cause a change of the hue of the compounds having a dye constitutional residue containing a reducible group (for example, a nitro group) in the dye constitutional part. Since such a change of the hue has a significant adverse influence upon color reproduction, it is very important from this point of view to select an oxidized developing agent scavenger that does not adversely affect the hue of a compound having a dye constitutional residue containing a reducible group in its dye constitutional part (for example, a monoazo naphthol dye having a nitro group).

(5) The oxidized developing agent scavenger should not produce photographically adverse effects caused by migration of the scavenger into each layer of the color photographic sensitive material. It is necessary that such an adverse effect is not substantially produced before, during, or after the processing of the color photographic sensitive material.

(6) The oxidized developing agent scavenger should be relatively independent of the processing temperature during development processing (i.e., it should have a broad latitude for the development processing temperature). This is particularly necessary for a color diffusion transfer process, which must have a high photographic sensitivity, a sufficiently large maximum density, a sufficiently low minimum density, and a suitable gradation, even if the processing temperature changes.

(7) The oxidized developing agent scavenger should neither cause deterioration of quality of the coated material because of precipitation of crystals during or after application thereof, nor produce colored by-products, because it does not cause an oxidation reaction during the application operation or processing.

Thus a continuing need has existed for compounds satisfying the above-described requirements for an oxidized developing agent scavenger.

SUMMARY OF THE INVENTION

Accordingly, a first object of this invention is to provide a novel oxidized developing agent scavenger suitable for a thin layer type sensitive material which results in high dye densities without exhibiting adverse influences upon the silver developing property of silver halide, and can effectively prevent color fogging.

A second object of this invention is to provide an oxidized developing agent scavenger which does not produce adverse effects (for example, change of hue) even if processed with a processing liquid having a high pH, such as in a color diffusion transfer process.

A third object of this invention is to provide color photographic sensitive materials containing an oxidized developing agent scavenger having properties as described above.

A fourth object of this invention is to provide color photographic sensitive materials containing an oxidized developing agent scavenger which have an inner latent image type silver halide emulsion layer combined with a dye image-forming material which provides a transfer image by a diffusible dye (for example, a dye releasing redox compound).

Other objects of this invention will be understood from the following description.

The above-described objects of the invention have been attained by incorporating a compound represented by formula (I) in a color photographic sensitive material.

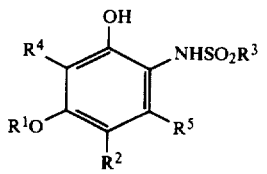

(I)

In formula (I), $R^1$ and $R^3$ can each represent an unsubstituted or substituted alkyl group or an unsubstituted or substituted aryl group, $R^2$ can represent an unsubstituted or substituted alkyl group, $R^4$ and $R^5$ can each represent a hydrogen atom, an unsubstituted or substituted alkyl group, an unsubstituted or substituted alkoxy group, an unsubstituted or substituted alkylthio group, an unsubstituted or substituted arylthio group, a halogen atom or an acylamino group, and $R^1$ and $R^2$, $R^1$ and $R^4$, or $R^2$ and $R^5$ together can represent atoms forming a condensed ring structure together with the benzene ring of formula (I), provided that the total of carbon atom numbers in $R^1$, $R^2$, $R^3$, $R^4$, and $R^5$ is at least 16.

DETAILED DESCRIPTION OF THE INVENTION

The unsubstituted or substituted alkyl group represented by $R^1$ has from 1 to 40 carbon atoms which may be a straight chain, branched chain, or cyclic group. Preferred examples include straight chain alkyl groups, such as a methyl group, an ethyl group, a butyl group, a hexyl group, an undecyl group, a dodecyl group, a hexadecyl group, an octadecyl group, and a 2-(2,4-di-t-acylphenoxy)ethyl group, and branched chain alkyl groups such as an isopropyl group, an isobutyl group, a t-butyl group, a t-amyl group, and a neopentyl group. The unsubstituted or substituted aryl group represented by $R^1$ has from 6 to 40 carbon atoms, examples of which include a phenyl group, a substituted phenyl group such as a p-tolyl group, a naphthyl group, etc.

The unsubstituted or substituted alkyl group represented by $R^2$ has from 1 to 40 carbon atoms, which may be a straight chain, branched chain, or cyclic group. Preferred examples include straight chain alkyl groups such as a methyl group, an ethyl group, a propyl group, a butyl group, a hexyl group, and an octyl group, etc., branched chain alkyl groups such as an isopropyl group, an isobutyl group, a t-butyl group, a t-amyl group, a t-hexyl group, a t-octyl group, or a neopentyl group, etc., and cyclic alkyl groups such as a cyclohexyl group or an adamantyl group, etc.

The unsubstituted or substituted alkyl group represented by $R^3$ has from 1 to 40 carbon atoms which may be a straight chain, branched chain, or cyclic group. Examples include a methyl group, an ethyl group, a butyl group, a hexyl group, an octyl group, a dodecyl group, a hexadecyl group, etc. The unsubstituted or substituted aryl group represented by $R^3$ has from 6 to 40 carbon atoms. Examples include a phenyl group, a p-tolyl group, a 4-dodecylphenyl group, etc.

The unsubstituted or substituted alkoxy group represented by $R^4$ or $R^5$ has from 1 to 40 carbon atoms which may be a straight chain, branched chain, or cyclic group. Examples include a methoxy group, an ethoxy group, and a butoxy group. The unsubstituted or substituted alkylthio group represented by $R^4$ or $R^5$ has from 1 to 40 carbon atoms, and may be a straight chain or branched chain group. Examples include a methylthio group and a butylthio group. The unsubstituted or substituted arylthio group represented by $R^4$ or $R^5$ has from 6 to 40 carbon atoms. An example is a phenylthio group. The halogen atom includes fluorine, chlorine, and bromine. The acylamino group represented by $R^4$ and $R^5$ has from 2 to 40 carbon atoms, examples of which include an acetylamino group and a benzoylamino group. The unsubstituted or substituted aryloxy group represented by $R^4$ or $R^5$ has from 6 to 40 carbon atoms, an example of which is a phenoxy group.

The alkyl group represented by $R^1$, $R^2$, $R^3$, $R^4$ or $R^5$ and the alkyl portion of the alkoxy group, the alkylthio group, or the alkylacylamino group represented by $R^4$ or $R^5$ may be substituted, for example, by alkoxy groups (for example, a methoxy group, an ethoxy group, etc.), a cyano group, a hydroxyl group, a halogen atom, an aryloxy group (for example, a phenoxy group, a naphthyloxy group, etc.), and an acylamino group (for example, an acetylamino group, a methanesulfonylamino group, etc.).

In the case wherein $R^1$ and $R^2$, $R^1$ and $R^4$ or $R^2$ and $R^5$ form a condensed ring structure, it is preferred that the ring formed is a 5- or 6-membered ring.

It is necessary that a total of carbon atom numbers in $R^1$, $R^2$, $R^3$, $R^4$ and $R^5$ is at least 16, in order to prevent diffusion during development.

In a preferred embodiment, the compound used in the present invention is an oil or has a melting point of 80° C. or less. In such a case, separation of crystals of the compound according to formula (I) is not observed in even the thin layer type photosensitive material.

In the following, examples of the compound used in the present invention are described. However, the present invention is not limited thereto.

(1)

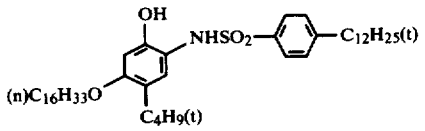

(2)

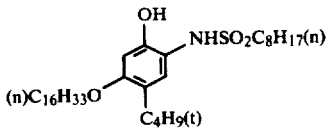

(3)

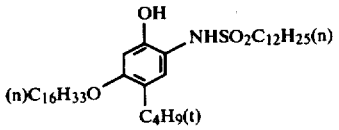

(4)

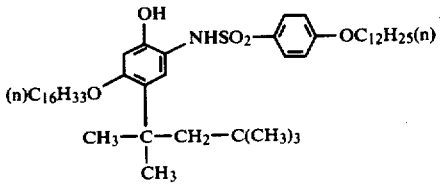

(5)

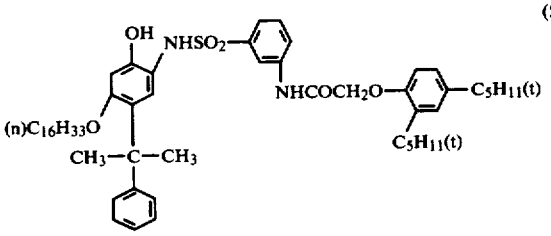

(6)

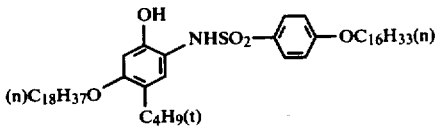

-continued (7)

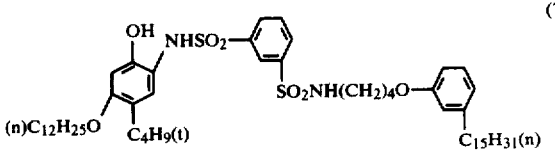

(8)

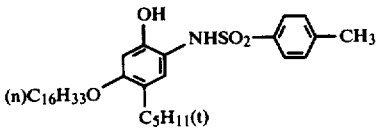

(9)

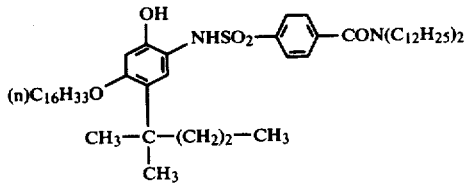

(10)

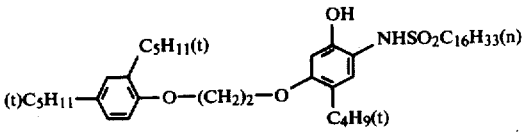

(11)

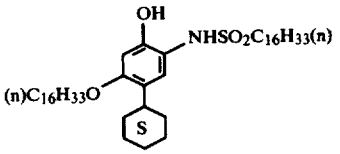

(12)

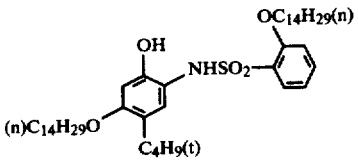

(13)

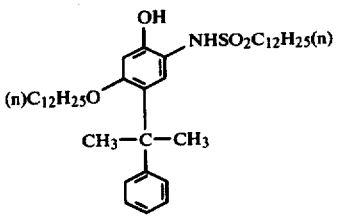

(14)

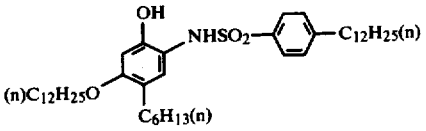

(15)

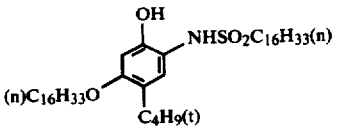

-continued

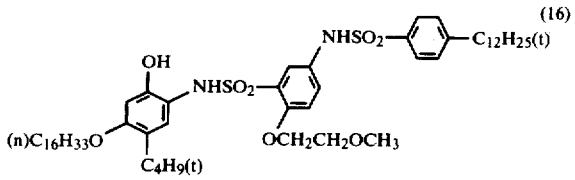

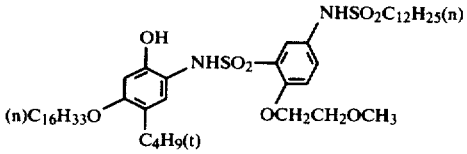

In the following, typical examples of synthesizing the compounds used in the present invention are described. Other compounds in addition to the compounds shown in examples can be synthesized according to the same general synthetic techniques.

Synthesis 1

Synthesis of 6-hydroxy-2-methylbenzoxazole (formation of oxazole ring by Beckmann rearrangement):

306 g of 2,4-dihydroxyacetophenone, 164 g of hydroxylamine hydrochloride, 328 g of sodium acetate, 1,000 ml of ethanol and 500 ml of water were mixed and refluxed with heating for 4 hours. The reaction solution was poured in 10 liters of water and the separated crystals were separated by filtration to obtain 314 g of oxime.

100 g of this 2,4-dihydroxyacetophenone oxime was dissolved in 700 ml of acetic acid, and hydrogen chloride gas was introduced by blowing for 2.5 hours into the solution while stirring at 120°-140° C. After cooled, the separated crystals were separated by filtration and washed with water to obtain 62 g of 6-hydroxy-2-methylbenzoxazole.

Synthesis 2

Synthesis of 6-hexadecyloxy-2-methylbenzoxazole (o-alkylation):

18.0 g of 6-hydroxy-2-methylbenzoxazole synthesized from Synthesis 1, 36.6 g of 1-bromohexadecane, 24.0 g of potassium carbonate and 120 ml of N,N-dimethylformamide were mixed with stirring at 90° C. for 4.5 horus. Solids were removed from the reacting solution, and the filtrate was poured into 500 ml of methanol. The separated crystals were separated by filtration to obtain 45.0 g of 6-hexadecyloxy-2-methylbenzoxazole.

Synthesis 3

Synthesis of 2-acetylamino-5-hexadecyloxyphenol (ring cleavage of oxazole ring):

111 g of 6-hexadecyloxy-2-methylbenzoxazole obtained in Synthesis 2, 1,300 ml of ethanol, 110 ml of 35% hydrochloric acid and 550 ml of water were mixed and stirred at 55°-60° C. for 4 hours. After cooled, the separated crystals were separated by filtration to obtain 113 g of 2-acetylamino-5-hexadecyloxyphenol.

Synthesis 4

Synthesis of 2-acetylamino-4-t-butyl-5-hexadecyloxyphenol (nucleus alkylation):

30.0 g of 2-acetylamino-5-hexadecyloxyphenol obtained in Synthesis 3, 20.0 g of Amberlist 15 (registered trademark of U.S. Rohm & Haas Co.) and 300 ml of toluene were mixed, and isobutene was introduced by blowing for 5 hours into the mixture while stirring at 80°-90° C. After removal of the solids, the filtrate was concentrated, and 350 ml of n-hexane was added to the residue by which crystals were separated. 23.5 g of 2-acetylamino-4-t-butyl-5-hexadecyloxyphenol was obtained by filtration.

Synthesis 5

Synthesis of 2-amino-4-t-butyl-5-hexadecyloxyphenol hydrochloride (deacetylation):

23.0 g of 2-acetylamino-4-t-butyl-5-hexadecyloxyphenol obtained in Synthesis 4, 120 ml of ethanol and 96 ml of 35% hydrochloric acid were mixed and refluxed for 5 hours with stirring. After the reacting solution was cooled, the separated crystals were separated by filtration to obtain 23.2 g of 2-amino-4-t-butyl-5-hexadecyloxyphenol hydrochloride.

Synthesis 6

Synthesis of Compound (1):

A 300 ml three-neck flask was charged with 44 g of 2-amino-4-t-butyl-5-hexadecyloxy-1-phenol hydrochloride, 34.5 g of dodecylbenzenesulfonyl chloride and 200 ml of N,N-dimethylacetamide, and 24 ml of pyridine was added dropwise thereto. After conclusion of addition, the mixture was stirred for 1 hour and poured into an aqueous hydrochloric acid solution. The product was extracted with ethyl acetate and purified by column chromatography.

Yield: 42 g (percent yield: 60%). Form: Oil.

Synthesis 7

Synthesis of Compound (2):

A 300 ml of three-neck flask was charged with 21.3 g of n-octylsulfonyl chloride, 44 g of 2-amino-4-t-butyl-5-hexadecyloxy-1-phenol hydrochloride and 200 ml of N,N-dimethylacetamide, and 24 ml of pyridine was added dropwise thereto. After conclusion of the addition, the mixture was stirred for 1 hour and poured into an aqueous hydrochloric acid solution. The product was extracted with ethyl acetate and thereafter separated by column chromatography. Then it was recrystallized with n-hexane. Yield: 24.5 g (percent yield: 43%), m.p.: 63°-64° C.

The oxidized developing agent scavengers according to the invention may be used in combinations of two or more thereof, or may be used together with hydroquinone derivatives as described in the above-described documents.

The oxidized developing agent scavengers according to the present invention may be incorporated in various layers of photosensitive material, for example, a silver halide emulsion layer (such as a blue-sensitive emulsion layer, a green-sensitive emulsion layer, or a red-sensitive emulsion layer) or an adjacent layer thereof (for example, an intermediate layer or a dye image-forming material-containing layer), a carbon black layer, or a light reflection layer. Preferably, they are incorporated in the silver halide emulsion layer, the intermediate layer or the dye image-forming material-containing layer, and more preferably in the intermediate layer.

The amount of the oxidized developing agent scavengers to be added in the present invention (equivalent of sulfonamidophenol residues in case of polymers) depends upon the purpose of use of the sensitive material, the kind of the dye image-forming compound (for example, a dye releasing redox compound or a coupler), the kind of the silver halide emulsion, layer construction and development processing, etc. In the case of addition to a layer containing a dye image-forming compound or to a silver halide emulsion layer, they are added in an amount of from 0.1 to 100 mols, and more preferably from 1 to 30 mols, per 100 mols of dye image-forming compound. In the case of addition to a layer other than the layer containing the dye image-forming material, they are added in an amount of from 1 to 100 mols, and preferably from 10 to 600 mols, per 100 mols of dye image-forming compound.

The silver halide emulsions used in the present invention are hydrophilic colloidal dispersions of silver chloride, silver bromide, silver chlorobromide, silver iodobromide, silver chloroiodobromide or mixtures of them. The halide can be selected according to the particular use and processing conditions to be used for the photosensitive material, but it is particularly preferred to use silver bromide, silver iodobromide, or silver chloroiodobromide having an iodide content of 10 mol % or less and a chloride content of 30 mol % or less.

The inner latent image type silver halide emulsions advantageously used in the present invention have been described in U.S. Pat. Nos. 2,592,250, 3,206,313, 3,447,927, 3,761,276 and 3,935,014.

Typical nucleus-forming agents for this type of emulsion include hydrazines described in U.S. Pat. Nos. 2,588,982 and 2,563,785, hydrazide and hydrazone described in U.S. Pat. No. 3,227,552, and quaternary salt compounds described in British Pat. No. 1,283,825, Japanese Patent Publication No. 38164/74 and U.S. Pat. Nos. 3,734,738, 3,719,494 and 3,615,615.

The silver halide emulsions used in the present invention may have their spectral sensitivity expanded by spectral sensitizing dyes, if desired.

Examples of the dye releasing redox compounds which are dye image donative compounds useful according to the present invention include those described, for example, in Japanese Patent Application (OPI) Nos. 33826/73, 126331/74, 104343/76, 46730/78, 113624/76 and 47823/78, *Research Disclosure*, Vol. 151, No. 15157 (published December 1976), Vol. 130, No. 13024 (published in February 1975) and Vol. 156, No. 15654 (published in April 1977), and Japanese Patent Application (OPI) Nos. 111628/74 and 63618/76.

In practicing the present invention, dye releasing redox compounds represented by formula (III) are preferably used.

$$Y—L—X \qquad \text{(III)}$$

In formula (III), Y represents a redox nucleus (carrier), X represents a dye moiety or a dye precursor moiety, and L represents a divalent bonding group or a chemical bond.

L comprises a divalent bonding group such as an alkylene group (or alkylidene group) having from 1 to 6 carbon atoms, an arylene group, or a heterocyclic group. This bonding group L bonds to the above-described X directly or through —O—, —S—, $—SO_2—$, $—NR_o—$ (where $R_o$ represents a hydrogen atom or an alkyl group), —CO—, —CONH—, or $—SO_2NH—$.

In principle, the above-described dye residue may be a residue of any kind of dye. However, this dye residue should preferably have a diffusibility sufficient to pass through the photographic layers in the photosensitive material to reach to the image receiving layer. For this purpose, if necessary, one or more water-solubilizing group is bonded to the dye residue. Examples of suitable water-solubilizing groups include the following groups: a carboxyl group, sulfo group, sulfonamide group, sulfamoyl group, and hydroxyl groups or an aromatic or aliphatic group.

Particularly suitable examples of dyes in the present invention include the following dyes: azo dyes, azomethine dyes, anthraquinone dyes, phthalocyanine dyes, indigoid dyes, triphenylmethane dyes, metal complex dyes and colored metal complexes.

The expression "dye precursor moiety" refers to a moiety of a compound capable of conversion into a dye in a conventional processing stage or an additional processing stage in the photographic processing step, by release of an auxochromic group (auxochrome) in the color forming system by oxidation (namely, by releasing the auxochrome to add to the chromophore). The dye precursor in this case may be a leuco dye or may be a dye capable of converting into another dye during the photographic processing.

Examples of Y effective for the redox compounds include N-substituted sulfamoyl groups. For example, a group represented by formula (A) is useful as Y.

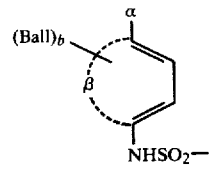

(A)

In the formula, $\beta$ represents a non-metal atomic group necessary to form a benzene ring, wherein the benzene ring may condense with a carbocyclic ring or a heterocyclic ring to form, for example, a naphthalene ring, a quinoline ring, a 5,6,7,8-tetrahydronaphthalene ring or a chroman ring. Further, the above-described benzene ring and the ring formed by condensing the benzene ring with the carbocyclic ring or the heterocyclic ring may be substituted by halogen atoms, alkyl groups, alkoxy groups, aryl groups, aryloxy groups, a nitro group, an amino group, alkylamino groups, arylamino groups, amido groups, a cyano group, alkylmercapto groups, a keto group, carboalkoxy groups, heterocyclic groups, etc.

$\alpha$ represents a group represented by $—OG^1$ or $—NHG^2$. $G^1$ represents a hydrogen atom or a group which forms a hydroxyl group by hydrolysis, and preferbly a hydrogen aton, $$—\overset{O}{\overset{\|}{C}}G^3 \text{ or } —\overset{O}{\overset{\|}{C}}—O—G^3,$$

wherein $G^3$ represents an alkyl group, particularly, an alkyl group having from 1 to 18 carbon atoms such as a methyl group, an ethyl group or a propyl group, a halogen substituted alkyl group having from 1 to 18 carbon atoms such as a chloromethyl group or a trifluoromethyl group, etc., a phenyl group or a substituted group. $G^2$ represents a hydrogen atom, an alkyl group having from 1 to 22 carbon atoms or a hydrolyzable group. As the hydrolyzable group in $G^2$, a preferred group is that represented by $$-\overset{\overset{\displaystyle O}{\|}}{C}G^4,$$

$-SO_2G^5$ or $-SOG^5$, wherein $G^4$ represents an alkyl group having from 1 to 4 carbon atoms, such as a methyl group, a halogen substituted alkyl group such as a mono-, di- or trichloromethyl group or a trifluoromethyl group, an alkylcarbonyl group such as an acetyl group, an alkyloxy group, a substituted phenyl group such as a nitrophenyl group or a cyanophenyl group, a phenyloxy group, unsubstituted, or substituted by lower alkyl groups or halogen atoms, a carboxyl group, an alkyloxycarbonyl group, an aryloxycarbonyl group, an alkylsulfonylethoxy group or an arylsulfonylethoxy group, and $G^5$ represents an unsubstituted or substituted alkyl group or aryl group.

Furthermore, b is 0 or an integer of 1 or 2. Preferably, b is 1 or 2, and more preferably is 1, except in the case wherein a group corresponding to an alkyl group which renders the compound represented by formula (A) immobilized and nondiffusible is introduced as $G^2$ of $-NHG^2$ into the above-described $\alpha$, namely, in the case wherein $\alpha$ is a group represented by $-OG^1$ and wherein $\alpha$ is a group represented by $-NHG^2$ wherein $G^2$ is a hydrogen atom, an alkyl group having from 1 to 8 carbon atoms or a hydrolyzable group. Ball represents a group which renders the compound antidiffusible.

Examples of Y according to formula (A) have been described in Japanese Patent Application (OPI) Nos. 33826/73, 50736/78, 54021/79 and 143230/79. As another example of Y suitable for this type of compound, there is a group represented by formula (B).

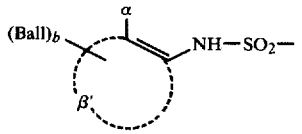

(B)

In formula (B), Ball, $\alpha$ and b each have the same meaning as in the case of the formula (A), and $\beta'$ represents an atomic group necessary to form a carbocyclic ring, for example, a benzene ring which may condense with another carbocyclic ring or a heterocyclic ring to form a naphthalene ring, a quinoline ring, a 5,6,7,8-tetrahydronaphthalene ring or a chroman ring, etc. Further, the above-described rings may be substituted by halogen atoms, alkyl groups, alkoxy groups, aryl groups, aryloxy groups, a nitro group, an amino group, alkylamino groups, arylamino groups, an amide group, a cyano group, alkylmercapto groups, a keto group, carboalkoxy groups and heterocyclic groups, etc. Examples of this kind of Y have been described in Japanese Patent Application (OPI) No. 113624/76, U.S. Pat. No. 4,053,312, the Japanese Patent Application (OPI) Nos. 149328/78, 65034/79, 111344/79 and 91187/79.

Further, couplers useful in the present invention have been described, for example, in *The Theory of Photographic Process,* 4th Edition, 1977, edited by T. H. James, Chapter 12. In the following, a case of using the redox compound is illustrated as a representative.

The amount of the dye releasing redox compound to be applied is from $1\times10^{-4}$ to $1\times10^{-2}$ mol/m$^2$, and preferably fron $2\times10^{-4}$ to $2\times10^{-3}$ mol/m$^2$.

The dye releasing redox compounds used in the present invention can be dispersed in a hydrophilic colloid as a dispersing medium by various methods according to the type of the compound. For example, a compound having a solubilizing group such as a sulfo group or a carboxyl group can be added to the hydrophilic colloid after the compound is dissolved in water or an aqueous alkaline solution. Dye releasing redox compounds which are difficult to dissolve in aqueous media but soluble in organic solvents are dissolved in an organic solvent and the resulting solution is added to a hydrophilic colloid solution to disperse it in fine particles by stirring. Suitable solvents include ethyl acetate, tetrahydrofuran, methyl ethyl ketone, cyclohexanone, $\beta$-butoxy-$\beta$-ethoxyethyl acetate, dimethylformamide, dimethyl sulfoxide, 2-methoxyethanol and tri-n-butyl phthalate, etc. Among these dispersing solvents, those having a comparatively low vapor pressure can be volatilized during drying of the photographic layers or can be volatilized by a method as described in U.S. Pat. Nos. 2,322,027 and 2,801,171 prior to application. Among these dispersing solvents, those soluble in water can be removed by a water wash method as described in U.S. Pat. Nos. 2,949,360 and 3,396,027. In order to stabilize the dispersion of the dye releasing redox compound and to accelerate the dye image-forming step, it is advantageous to incorporate a solvent having a boiling point of at least 200° C. under a normal pressure (which is substantially insoluble with respect to water in the photographic element) together with the dye releasing redox compound. As high boiling point solvents suitable for this purpose, there are higher aliphatic acid triglycerides, aliphatic esters such as dioctyl adipate, phthalic acid esters such as di-n-butyl phthalate, phosphoric acid esters such as tri-o-cresyl phosphate or tri-n-hexyl phosphate, amides such as N,N-diethyllaurylamide, and hydroxy compounds such as 2,4-di-n-amylphenol, etc. In order to further stabilize the dispersion of the dye releasing redox compound and to accelerate the dye image forming step, it is advantageous to incorporate a solventphilic polymer in the photographic element together with the dye releasing redox compound. Examples of solventphilic polymers suitable for this purpose include shellac, phenol-formaldehyde condensates, poly-n-butyl acrylate, copolymer of n-butyl acrylate and acrylic acid, and copolymer of n-butyl acrylate, styrene and methacrylamide, etc. These polymers may be dispersed in the hydrophilic colloid after they were dissolved in an organic solvent together with the dye releasing redox compound. Furthermore, a hydrosol of the polymer prepared by emulsion polymerization, etc., may be added to a hydrophilic colloid of the dye releasing redox compound. Generally, dispersion of the dye releasing redox compound is effectively attained by mixing under a high shearing stress. The dispersion of the dye releasing redox compound is remarkably promoted by using surface active agents as an emulsifier assistant. Examples of surface active agents suitable for dispersing the dye releasing redox compound used in the present invention include sodium triisopropylnaphthalene sulfonate, sodium dinonylnaphthalenesulfonate, sodium p-dodecylbenzenesulfonate, sodium salt of dioctylsulfosuccinate and anionic surface active agents described in Japanese Patent Publication No. 4293/64. When these anionic surface active agents are used together with higher aliphatic acid ester of anhydrohexitol, a particularly excellent emulsification ability is exhibited, as disclosed in U.S. Pat. No. 3,676,141.

The oxidized developing agent scavenger used in the present invention can be dispersed by the same method as that for dispersing the dye releasing redox compound.

Examples of the hydrophilic colloids used for dispersing the oxidized developing agent scavenger and the dye releasing redox compounds in the present invention include gelatin, colloidal albumin, casein, cellulose derivatives such as carboxymethyl cellulose or hydroxyethyl cellulose, etc., saccharide derivatives such as agar, sodium alginate or starch derivatives, etc., and hydrophilic colloids such as polyvinyl alcohol, poly-N-vinylpyrrolidone, acrylic acid copolymers, polyacrylamide and derivatives of them (for example, partially hydrolyzed products), etc. If desired, these colloids may be used as a compatible mixture of two or more thereof. Among them, gelatin is generally the most suitable colloid, but a part or the whole of gelatin may be substituted by a synthetic hydrophilic colloid.

Examples of the dye releasing redox compounds having a dye constitutional residue containing a reducible group in the dye structural part have been described in Japanese Patent Application (OPI) Nos. 126331/74, 109928/76 and 99431/79.

Processes for obtaining color diffusion transfer images using dye releasing redox compounds have been described in *Photographic Science and Engineering*, Vol. 20, No. 4, pages 155–164, July/August 1976.

In the above-described processes, any silver halide developing agent may be used, provided that it causes cross oxidation of the dye releasing redox compound. Such a developing agent may be incorporated in the alkaline processing composition or may be contained in a suitable layer of the photographic element. Examples of the developing agent capable of use in the present invention include the following:

Hydroquinones, aminophenols (for exaple, N-methylaminophenol), pyrazolidinones (for example, phenidone, 1-phenyl-3-pyrazolidinone, dimezone (1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone and 1-phenyl-4-methyl-4-oxymethyl-3-pyrazolidinone) and phenylenediamines (for example, N,N-diethyl-p-phenylenediamine, 3-methyl-N,N-diethyl-p-phenylenediamine, and 3-methoxy-N-ethoxy-p-phenylenediamine).

Among the above-described developing agents, generally, black-white developing agents having a property of reducing stain formation in the image-receiving layer (particularly, pyrazolidinones) are preferred as compared with color developing agents such as phenylenediamines.

The processing composition contains a base, such as sodium hydroxide, potassium hydroxide, sodium carbonate, or sodium phosphate, and has a pH of 9 or more, and preferably 11.5 or more. The processing composition contains antioxidants such as sodium sulfite, ascorbic acid salts, or piperidinohexose leductone and may contain a silver ion content controller, such as potassium bromide. Further, it may contain a compound for increasing the viscosity, such as hydroxyethyl cellulose or sodium carboxymethyl cellulose.

Further, the alkaline processing composition may contain a compound for accelerating development or promoting diffusion of dyes (for example, benzyl alcohol).

In the photosensitive element to which the present invention can be applied, the silver halides are combined with the dye image donators. Combinations of spectral sensitivity of the silver halide emulsion and spectral absorption of the dye image are suitably selected according to the desired color reproduction. In order to reproduce natural color by a subtractive process, a photographic element comprising at least two combinations of an emulsion having a selective spectral sensitivity in a certain wavelength range and a dye image donator having a selective spectral absorption in the same wavelength range is used. Particularly, a photographic element comprising a combination of a blue-sensitive silver halide emulsion and a yellow dye releasing redox compound, a combination of a green-sensitive emulsion and a magenta dye releasing redox compound and a combination of a red-sensitive emulsion and a cyan dye releasing redox compound is useful. In order to prevent unsuitable interaction between emulsions having different spectral sensitivities, intermediate layers are provided between emulsion layers.

Combination units of these emulsions and dye releasing redox compounds may be superposed so as to have a face-to-face relation in the photographic element, or they may be mixed by forming particles (the dye releasing redox compound and the silver halide particle are present in the same particle) and applied as a monolayer.

An isolation layer may be provided between the intermediate layer and the layer containing the dye image donator as described in Japanese Patent Application (OPI) No. 52056/80. Further, a silver halide emulsion may be added to the intermediate layer as described in Japanese Patent Application (OPI) No. 144155/79.

A mordanting layer, a neutralizing layer, a neutralization rate controlling layer (timing layer) and a processing composition, etc., capable of using in the photosensitive material for a color diffusion transfer process of the present invention have been described in, for example, Japanese Patent Application (OPI) No. 64533/77.

It is preferred that the photosensitive material for a color diffusion transfer process of the present invention be a monosheet type film unit (combination of a photosensitive element, an image receiving element and a processing element) unified in a body before, during, and after exposure, which is developable in the light. Such film units are described in *Photographic Science and Engineering*, ibid., and *Neblettes Handbook of Photography and Reprography Materials, Process and Systems*, Seventh Ed. (1977), Chapter 12, etc.

The color photographic materials of the present invention includes, of course, not only a color diffusion transfer material, but also a conventional color photographic material.

Preferred embodiments of the present invention are as follows.

(1) A color photosensitive material wherein a photosensitive sheet comprising an inner latent image type silver halide emulsion layer combined with a dye image forming compound, and a layer containing a compound represented by formula (I) on a base is processed with an alkaline processing composition.

(2) A color photosensitive material as described in (1) above, wherein the dye image forming compound is a dye releasing redox compound.

(3) A color photosensitive material as described in (2) above, wherein the dye released from the dye releasing redox compound contains a reducible moiety.

(4) A color photosensitive material as described in (2) above, which is processed with an alkaline processing composition containing pyrazolidinones as a developing agent.

(5) A photosensitive sheet for a color diffusion transfer process which is a monosheet type film unit capable of developing in light which is unified as a single body before, during, and after exposure, wherein said photosensitive sheet comprises an inner latent image type silver halide emulsion layer combined with a dye releasing redox compound and a layer containing a compound represented by formula (I) coated on a base (support).

(6) Color photosensitive materials as described in (1) to (4) above which are used for a color diffusion transfer process.

EXAMPLE 1

In order to examine the effect of a compound as a scavenger for the oxidized developing agent, a two-color Photosensitive Sheet A was produced by applying the following layers to a transparent polyethylene terephthalate in order.

(1) A mordanting layer containing 3.0 g/m$^2$ of copoly-(styrene-N-vinylbenzyl-N,N,N-trihexylammonium chloride) and 3.0 g/m$^2$ of gelatin.

(2) A light reflection layer containing 20 g/m$^2$ of titanium dioxide and 2.0 g/m$^2$ of gelatin.

(3) A light shielding layer containing 3.0 g/m$^2$ of carbon black and 2.0 g/m$^2$ of gelatin.

(4) A layer containing 0.35 g/m$^2$ of a magenta dye releasing redox compound having the following structure and 0.5 g/m$^2$ of gelatin

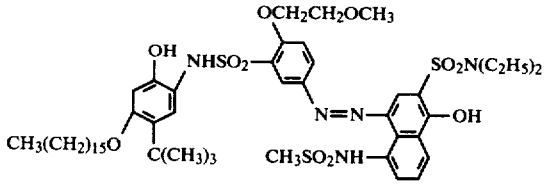

(5) A layer containing a green-sensitive inner latent image type direct reversal silver bromide emulsion (1.0 g/m$^2$ as a silver content), 1.0 g/m$^2$ of gelatin, 0.04 mg/m$^2$ of a nucleus forming agent having the following structure and 0.12 g/m$^2$ of sodium salt of 2-sulfo-5-n-pentadecylhydroquinone

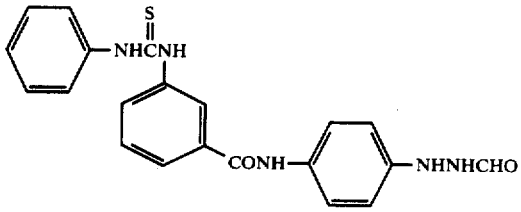

(6) A layer containing 0.9 g/m$^2$ of the oxidized developing agent scavenger of the present invention; Compound (1), 0.5 g/m$^2$ of tricyclohexyl phosphate and 1.0 g/m$^2$ of gelatin.

(7) A layer containing 0.53 g/m$^2$ of a yellow dye releasing redox compound having the following structure, 0.13 g/m$^2$ of tricyclohexyl phosphate and 0.7 g/m$^2$ of gelatin

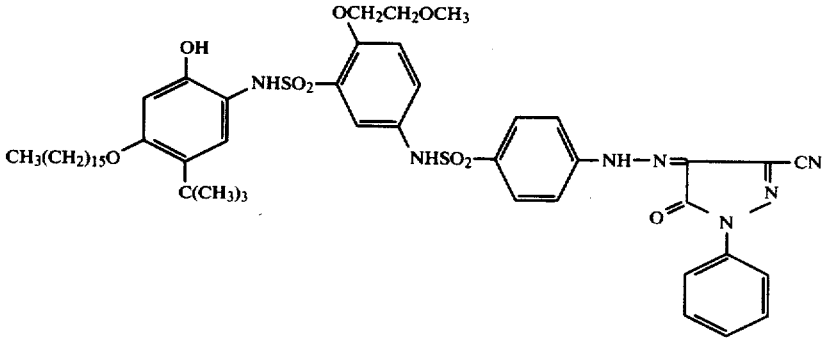

(8) A layer containing 1.0 g/m$^2$ of gelatin.

A photosensitive sheet B and Comparative Photosensitive Sheets C, D and E were produced by the same general process as described above, with the following differences:

Photosensitive Sheet B

The same photosensitive sheet as A, except that tricyclohexylphosphate as dispersing oil in the layer (6) of the Photosensitive Sheet A was removed.

Photosensitive Sheet C

The same photosensitive sheet as A, except that the oxidized developing agent scavenger in the layer (6) of the Photosensitive Sheet A was substituted by an equimolar amount of 4-benzenesulfonamide-1-hydroxy-N-[4-(2,4-di-t-pentylphenoxy)butyl]-2-naphthamide, described in *Research Disclosure*, Nov., (1976), No. 15162.

Photosensitive Sheet D

The same photosensitive sheet as C, except that tricycohexylphospahte as dispersing oil in the layer (6) of the Photosensitive Sheet C was removed.

Photosensitive Sheet E

The same photosensitive sheet as B, except that the comound described in Japanese Patent Application (OPI) No. 29637/79: 2,5-di-t-pentadecylhydroquinone was applied in an equimolar amount instead of the oxidized developing agent scavenger in the layer (6) of the Photosensitive Sheet B.

After the above-described photosensitive sheets were subjected to step-wedge exposure, they were unified with a container containing a viscous processing solution and a cover sheet, and processed by a pressing member at 25° C. to spread the processing fluid in a thickness of 80 microns, by which transfer images were obtained. The composition of the processing solution was as follows:

| | |
|---|---|
| 1-p-Tolyl-4-hydroxymethyl-4-methyl-3-pyrazolidone | 8 g |
| Methylhydroquinone | 0.3 g |
| 5-Methylbenzotriazole | 3.5 g |
| Sodium sulfite (anhydrous) | 0.2 g |
| Na salt of carboxymethyl cellulose | 58 g |
| Potassium hydroxide (28% aq. soln.) | 200 cc |
| Benzyl alcohol | 1.5 cc |
| Carbon black | 150 g |
| Water | 685 cc |

The cover sheet was prepared by applying the following layers to a transparent polyethylene terephthalate film base, in the order listed.

(1) A layer applied in a thickness of 7 microns which contained 17 g/m$^2$ of polyacrylic acid, 0.06 g/m$^2$ of N-hydroxysuccinimidobenzenesulfonate and 0.5 g/m$^2$ of ethylene glycol.

(2) A timing layer prepared by applying acetyl cellulose (degree of acetylation 54) in a thickness of 2 microns.

(3) A timing layer prepared by applying a copolymer latex of vinylidene chloride and acrylic acid in a thickness of 4 microns.

Each photosensitive sheet was preserved for 1 week at 45° C. at a relative humidity of 70% in a pure oxygen atmosphere. After preservation the sample was exposed to light and processed as described above.

In the photosensitive sheet, the oxidized developing agent scavenger-containing layer (6) is provided for the purpose of preventing release of a yellow dye by reacting with the oxidized developing agent formed in the green-sensitive silver halide emulsion layer (5) when the oxidized developing agent passes through the layer (6) to diffuse in the yellow dye releasing redox compound-containing layer (7) which was not combined with the silver halide emulsion layer (5) (by which impure magenta color is prevented, namely, the phenomenon wherein yellow is added to magenta to cause deterioration of the magenta hue).

Accordingly, the scavenging ability of the scavenger for oxidized developing agent in the intermediate layer was determined by measuring the degree of color stain of the yellow dye in the magenta image (blue filter density) after the photosensitive sheet was preserved at 45° C. and a relative humidity of 70% for 1 week.

A preferred property of the oxidized developing agent scavenger is that it has an ability of effectively preventing color stain while still providing a high maximum density of the transfer image. Namely, the oxidized developing agent scavenger should have a reactivity sufficient to prevent the color stain, but the reactivity thereof should not be so high that the image dye density is seriously damaged.

Results of the examination are shown in Table 1. The transfer image was measured by a color densitometer. $D^{max}{}_g$ (green filter density): maximum density of magenta image dye, $D^{max}{}_b$ (blue filter density): maximum density of yellow image dye are shown. But the value of $D^{max}{}_g$ is that which was corrected so as to remove blue absorption of the magenta dye in order to easily evaluate the degree of color stain.

TABLE 1

| Photosensitive Sheet | Density: Fresh $D^g_{max}$ | Density: Fresh $D^b_{max}$ | Density: After Preservation $D^g_{max}$ | Density: After Preservation $D^b_{max}$ | |
|---|---|---|---|---|---|
| A | 1.82 | 0.04 | 1.80 | 0.06 | This invention |
| B | 1.91 | 0.05 | 1.84 | 0.06 | " |
| C | 1.75 | 0.07 | 1.74 | 0.25 | Comparison |
| D* | — | — | — | — | " |
| E | 1.62 | 0.21 | 1.48 | 0.82 | " |

*Evaluation was impossible because of separation of the oxidized developing agent scavenger.

It is clear from Table 1 that the Photosensitive Sheets A and B of the present invention show a small $D^{max}{}_b$, even after preservation, which means low color stain.

EXAMPLE 2

A Photosensitive Material (I) of the present invention and a Photosensitive Material (II) for comparison having a construction and composition as described below were prepared. After 1 week, photosensitive material preserved at 45° C. and 70% RH (relative humidity) for 3 days and that preserved in a room at 25° C., 50% RH for 3 days were compared. Each photosensitive material was exposed to light through an optical wedge having a density difference of 0.2, using a 2,854° K. tungsten lamp (the maximum exposure in this case was 10 CMS). Each photosensitive material was processed by passing through a pair of paralleled pressing rolls.

The Photosensitive Material (I) of the present invention was a sheet sensitive material which comprised a Photosensitive Element (I) prepared by applying the following layers to a transparent polyethylene terephthalate base in the order, the following cover sheet fixedly laminated so as to have a face-to-face relation, and a bag container capable of breaking by pressure between both elements at the edge thereof so as to spread the alkaline viscous processing solution between both elements (this bag container contained a viscous processing liquid having the following composition) which were combined in a body.

Construction and Composition of Photosensitive Sheet:

(1) A mordanting layer containing 3.0 g/m$^2$ of copoly(styrene-N-vinylbenzyl-N,N,N-trihexylammonium chloride) and 3.0 g/m$^2$ of gelatin.

(2) A light reflection layer containing 20 g/m$^2$ of titanium dioxide and 2.0 g/m$^2$ of gelatin.

(3) A light shielding layer containing 3.0 g/m$^2$ of carbon black and 2.0 g/m$^2$ of gelatin.

(4) A layer containing a cyan dye releasing redox compound having the following structure (0.44 g/m$^2$), tricyclohexyl phosphate (0.09 g/m$^2$) and gelatin (0.8 g/m$^2$)

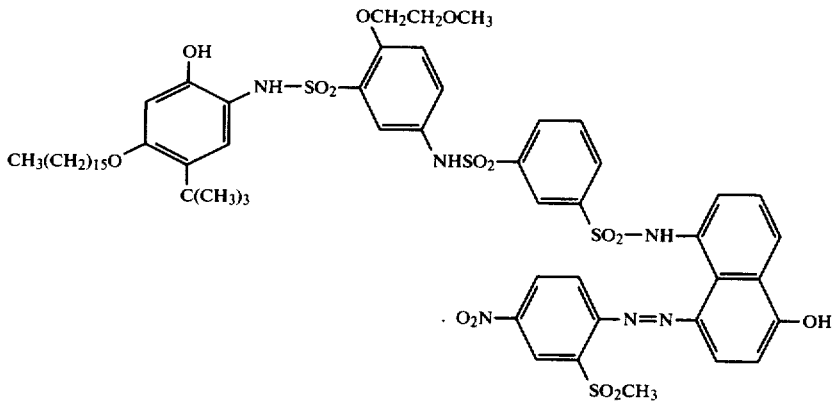

(5) A layer containing a red-sensitive inner latent image type direct reversal silver bromide emulsion (10.3 g/m$^2$ silver content), gelatin (1.2 g/m$^2$), a nucleus forming agent having the following structure (0.05 mg/m$^2$) and sodium salt of 2-sulfo-5-n-pentadecylhydroquinone (0.13 g/m$^2$)

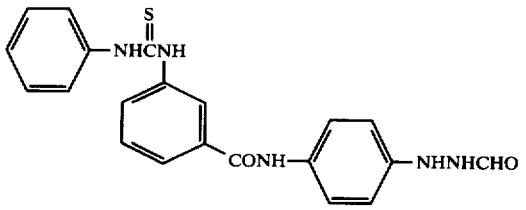

(6) A layer containing Compound (1) of the present invention (1.34 g/m$^2$) and gelatin (1.2 g/m$^2$).

(7) A layer containing a magenta dye releasing redox compound having the following Structure I (0.21 g/m$^2$), a magenta dye releasing redox compound having the following Structure II (0.11 g/m$^2$), tricyclohexyl phosphate (0.08 g/m$^2$) and gelatin (0.9 g/m$^2$)

Structure I

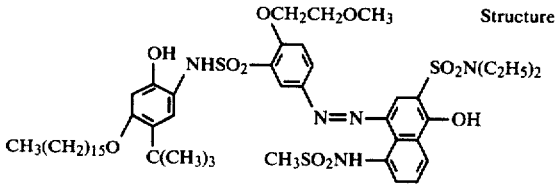

Strusture II

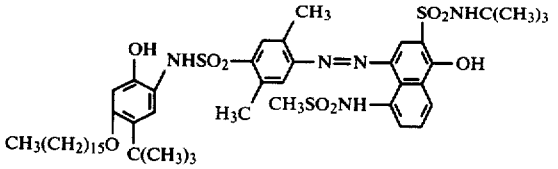

(8) A layer containing a green-sensitive inner latent image type direct reversal silver bromide emulsion (0.82 g/m$^2$ as silver content), gelatin (0.9 g/m$^2$), the same nucleus forming agent as in the layer (5) (0.03 mg/m$^2$) and sodium salt of 2-sulfo-5-n-pentadecylhydroquinone (0.08 g/m$^2$).

(9) A layer identical to the layer (6).

(10) A layer containing a yellow dye releasing redox compound having the following structure (0.53 g/m$^2$), tricyclohexyl phosphate (0.13 g/m$^2$) and gelatin (0.7 g/m$^2$)

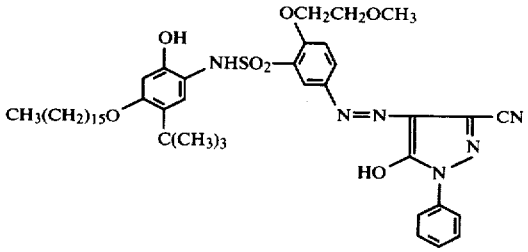

(11) A layer containing a blue-sensitive inner latent image type direct reversal silver bromide emulsion (1.09 g/m$^2$ silver content), gelatin (1.1 g/m$^2$), the same nucleus forming agent as in the layer (5) (0.04 mg/m$^2$) and sodium salt of 2-sulfo-5-n-pentadecylhydroquinone (0.07 g/m$^2$).

(12) A layer containing gelatin (1.0 g/m$^2$).

The following layers (1') to (3') were applied in the order to a transparent polyester base to produce a cover sheet.

(1') A layer containing a 80:20 (ratio by weight) copolymer of acrylic acid and butyl acrylate (22 g/m$^2$) and 1,4-bis(2,3-epoxypropoxy)butane (0.44 g/m$^2$).

(2') A layer containing acetyl cellulose (100 g of acetyl cellulose is hydrolyzed to form 39.4 g of acetyl group), (3.8 g/m$^2$) and a 60:40 (ratio by weight) copolymer of styrene and maleic acid anhydride (molecular weight: about 50,000) (0.2 g/m$^2$) and 5-($\beta$-cyanoethylthio)-1-phenyltetrazole (0.115 g/m$^2$).

(3') A layer containing a 85:12:3 (ratio by weight) copolymer latex of vinylidene chloride, methyl acrylate, and acrylic acid (2.5 g/m$^2$), and polymethyl methacrylate latex (particle size: 1–3 $\mu$m) (0.05 g/m$^2$).

As a comparative sample for the Photosensitive Material (I) of the present invention, Comparative Photosensitive Sheet (II) was produced by the same procedure as in the case of Photosensitive Material (I), except that the layers (6) and (9) in the Photosensitive Sheet (I) were substituted by the following layers (6') and (9').

Layer (6'): A color stain preventing agent layer containing gelatin (1.2 g/m$^2$) and 2,5-di-t-pentadecylhydroquinone (1.0 g/m$^2$).

Layer (9'): The same as the layer (6').

TABLE 2

| Photosensitive Material | Preservation Condition: In Room (25° C., 60% RH) for 3 Days, Reflection Density 1 Hour after Processing: Maximum Density | Minimum Density | At 45° C., 70% RH for 3 Days, Reflection Density 1 Hour after Processing: Maximum Density | Minimum Density |
|---|---|---|---|---|
| Photosensitive Material (I) | | | | |
| Yellow Density | 1.84 | 0.26 | 1.78 | 0.26 |
| Magenta Density | 2.02 | 0.26 | 2.00 | 0.26 |
| Cyan Density | 1.93 | 0.29 | 1.90 | 0.29 |
| Comparative Photosensitive Material (II) | | | | |
| Yellow Density | 1.78 | 0.26 | 1.67 | 0.26 |
| Magenta Density | 1.89 | 0.26 | 1.41 | 0.26 |
| Cyan Density | 1.79 | 0.30 | 1.58 | 0.29 |

It is understood from the results shown in Table 2 that maximum densities of yellow, magenta and cyan transfer dyes in the Photosensitive Material (I) of the present invention are high and stabilized in both types of preservation condition, while the maximum densities in the Comparative Photosensitive Material (II) are lower than those in the Photosensitive Material (I), and the maximum densities of the transfer image in the case of the severe preservation condition deteriorate significantly.

Further, the Photosensitive Sheet (I) has an excellent color separating property and, particularly, excellent hue of cyan and green, as compared with the Photosensitive Sheet (II).

EXAMPLE 3

Photosensitive Sheet (III) was produced by applying the following layers to a transparent polyester base in order.

(1)–(5) the same layers as those in Example 2.

(6) A layer containing Compound (1) of the present invention 1.34 g/m$^2$, N,N-diethyllaurylamide 0.2 g/m$^2$ and gelatin 0.8 g/m$^2$.

Likewise, Photosensitive Sheets (IV) and (V) and Comparative Photosensitive Sheets (VI) and (VII) were produced.

Photosensitive Sheet (IV)

The same as the Photosensitive Sheet (III), except that Compound (2) of the present invention was used as the oxidized developing agent scavenger in an equimolar amount.

Photosensitive Sheet (V)

The same as described above, wherein Compound (4) of the present invention was used.

Photosensitive Sheet (VI)

The same as the Photosensitive Sheet (III), except that the compound described in Japanese Patent Application (OPI) No. 29637/79; 2,5-di-t-pentadecylhydroquinone was used as the oxidized developing agent scavenger in an equimolar amount.

Photosensitive Sheet (VII)

The same as described above, wherein 2,5-di-sec-dodecylhydroquinone as described in U.S. Pat. No. 3,700,453 was used.

After the above-described photosensitive sheets were subjected to wedge exposure, they were subjected to spread processing at 25° C. using the same cover sheet and processing solution as those in Example 2. After 1 day, a density of the cyan transfer image was measured by a color densitometer to obtain results shown in Table 3. (Red filter density is shown as Dr, and green filter density is shown as Dg.)

TABLE 3

| Sample | Value of Dg at Dr = 1.0 | Note |
|---|---|---|
| Photosensitive Sheet (III) | 0.33 | This Invention |
| Photosensitive Sheet (IV) | 0.33 | " |
| Photosensitive Sheet (V) | 0.33 | " |
| Photosensitive Sheet (VI) | 0.40 | Comparison |
| Photosensitive Sheet (VII) | 0.53 | " |
| Sample colored with cyan dye. | 0.33 | * |

*A sample colored by dipping a coated product composed of the layers (1) to (3) in this example in a solution of the following cyan dye in 0.1N NaOH.

The cyan hue is preferred as the value of Dg/Dr decreases. It is understood from Table 3 that the value of Dg at Dr=1.0 in the Photosensitive Sheets (III) to (V) using compounds of the present invention is equal to that of the sample colored with cyan dye, which means that there was substantially no change of the cyan dye image.

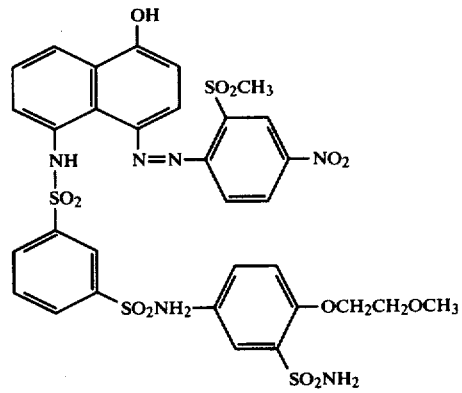

While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material comprising a compound represented by formula (I)

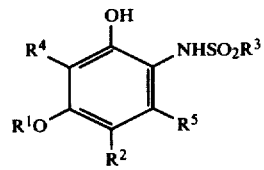

(I)

wherein $R^1$ and $R^3$ can each represent an unsubstituted or substituted alkyl group or an unsubstituted or substituted aryl group, $R^3$ being a group which produces no colored by-products and causes no oxidization reaction, $R^2$ can represent an unsubstituted or substituted alkyl group, $R^4$ and $R^5$ can each represent a hydrogen atom, an unsubstituted or substituted alkyl group, an unsubstituted or substituted aryloxy group, an unsubstituted or substituted alkylthio group, an unsubstituted or substituted arylthio group, a halogen atom, or an acylamino group, and $R^1$ and $R^2$, and $R^4$, or $R^2$ and $R^5$ together can represent atoms forming a condensed ring structure together with the benzene ring of formula (I), provided that the total of carbon atom numbers in $R^1$, $R^2$, $R^3$, $R^4$ and $R^5$ is at least 16, said light-sensitive material further comprising a dye image-receiving layer.

2. A color photographic sensitive material as in claim 1 comprising an inner latent image type silver halide emulsion layer combined with a dye image forming compound, and a layer containing a compound represented by formula (I).

3. A color photographic sensitive material as in claim 2, wherein the dye image forming compound is a dye releasing redox compound.

4. A color photographic sensitive material as in claim 3, wherein the dye releasable from the dye releasing redox compound contains a reducible moiety.

5. A color photographic sensitive material as in claim 2 for use in a color diffusion transfer process, comprising a monosheet type film unit capable of developing in light which is unified as a single body before, during, and after exposure.

6. A color photographic sensitive material as in claim 5, wherein the dye image forming compound is a dye releasing redox compound.

7. A color photographic sensitive material as in claim 6, wherein the dye releasable from the dye releasing redox compound contains a reducible moiety.

8. A color photographic sensitive material as in claim 1, 2, 3, 4, 5, 6 or 7, wherein each of $R^1$, $R^2$, $R^3$, $R^4$ and $R^5$ has from 1 to 40 carbon atoms.

9. A color photographic silver halide light-sensitive material as in claim 3 or 5, wherein the dye releasing redox compound is represented by formula (III)

$$Y—L—X \qquad \text{(III)}$$

wherein Y represents a redox nucleus, X represents a dye moiety or dye precursor moiety, and L represents a divalent bonding group or a chemical bond.

10. A color photographic silver halide light-sensitive material as in claim 9, wherein L comprises a divalent bonding group selected from an alkylene group or alkylidene group having from 1 to 6 carbon atoms, and arylene group, or a heterocyclic group, bonded to X either directly or through —O—, —S—, —$SO_2$—, —N-$R_o$—, —CO—, —CONH—, or —$SO_2$NH—, wherein $R_o$ represents a hydrogen atom or an alkyl group.

11. A color photographic silver halide light-sensitive material as in claim 1 wherein $R^3$ is selected from the group consisting of a phenyl group, a p-tolyl group, and a 4-dodecylphenyl group.

* * * * *